United States Patent [19]

Konarik

[11] Patent Number: 4,785,971

[45] Date of Patent: Nov. 22, 1988

[54] BAG STORAGE AND DISPENSING APPARATUS

[76] Inventor: Michael A. Konarik, St. Rte. 1, Box 16, Ganado, Tex. 77962

[21] Appl. No.: 731,455

[22] Filed: May 6, 1985

[51] Int. Cl.[4] ..... B65G 59/00

[52] U.S. Cl. ..... 221/312 R; 221/306; 221/282; 221/283; 312/290; 312/183

[58] Field of Search ..... 221/26, 33, 34, 44, 221/45, 282, 283, 303, 306, 312 R, 312 C; 248/95; 211/55, 184, 162, 153, 134, 128, 59.4, 52, 50; 206/554, 555; 312/290, 283, 183, 50, 42, 327, 328, 120

[56] References Cited

U.S. PATENT DOCUMENTS

| | | | |
|---|---|---|---|
| 663,726 | 12/1900 | Carlen . | |
| 755,001 | 3/1904 | Henderson . | |
| 1,441,410 | 1/1923 | Eustis | 312/50 X |
| 1,581,099 | 4/1926 | Carlson . | |
| 1,595,263 | 8/1926 | Thornberry | 312/328 X |
| 2,044,231 | 6/1936 | Smith | 312/50 |
| 2,123,592 | 7/1938 | Torgeson et al. | 211/51 |
| 2,245,518 | 6/1941 | Allen | 211/51 |
| 2,426,136 | 8/1947 | Agamaite, Jr. | 312/50 |
| 2,775,365 | 12/1956 | Mestman et al. | 221/44 |
| 2,781,151 | 2/1957 | Campbell, Jr. | 221/45 |
| 2,936,899 | 5/1960 | Tashman | 211/134 X |
| 3,087,647 | 4/1963 | Heller | 221/47 |
| 3,199,723 | 8/1965 | Hein | 221/47 |
| 3,753,606 | 8/1973 | Ozeki | 312/183 X |
| 3,777,439 | 12/1973 | Fried | 206/554 |
| 3,782,073 | 1/1974 | Musser | 206/554 |
| 4,328,631 | 5/1982 | Foerster | 211/55 X |
| 4,407,473 | 10/1983 | Howe, Jr. | 248/95 |
| 4,479,684 | 10/1984 | Doyel | 211/50 X |

FOREIGN PATENT DOCUMENTS

| | | | |
|---|---|---|---|
| 87171 | 11/1920 | Fed. Rep. of Germany | 312/290 |
| 671610 | 5/1952 | United Kingdom | 312/290 |

*Primary Examiner*—Joseph J. Rolla
*Assistant Examiner*—David H. Bollinger
*Attorney, Agent, or Firm*—Browning, Bushman, Zamecki & Anderson

[57] ABSTRACT

Apparatus for storing and dispensing bags includes a container having an interior cavity featuring at least one pair of mutually opposed longitudinal members disposed along the interior surfaces of elongate sides of the container. The members in part define opposed compartments whereby bags may be positioned within the cavity and retained by the members for storage and/or selective removal from the container.

28 Claims, 4 Drawing Sheets

FIG. 8
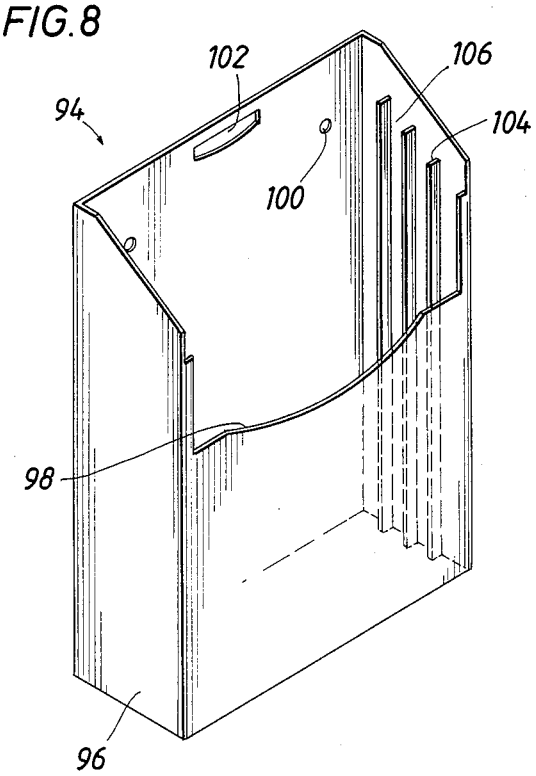
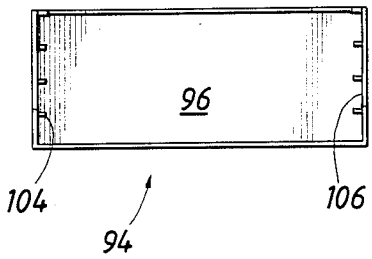
FIG. 9
FIG. 10
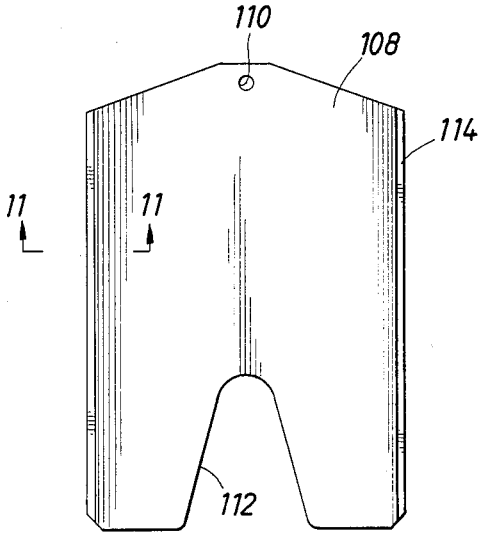
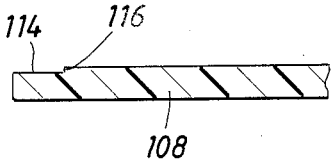
FIG. 11

BAG STORAGE AND DISPENSING APPARATUS

BACKGROUND OF THE INVENTION

1. Field of the Invention

This invention pertains to techniques for retaining and dispensing bags. More particularly, the invention relates to apparatus for storing bags, such as foldable paper sacks and the like, and including bags of different sizes, while permitting bags to be selectively removed one at a time or in groups.

2. Description of the Prior Art

Various bag storage and dispensing devices are known in which the stored bags are held partly under compression. Generally, such devices dispense the end bag in a stack. It is desirable and advantageous to provide for storage of different sized bags, and to allow bags to be dispensed from a storage facility one at a time, or in groups.

SUMMARY OF THE INVENTION

The present invention provides a container for storing and dispensing bags. The container includes two opposed interior surfaces that define a cavity in part, and at least one pair of mutually opposed longitudinal flange members disposed substantially along the interior surfaces. The members define, at least in part, parallel opposed compartments and retain bags positioned within the container whereby the bags can be selectively removed. Access to the cavity may be provided by an opening in the container, such that the bags may be stored and removed as desired.

The access may be selectively closed and opened, as by a door hinged to the container, for example. A second door may also be hinged to the container and selectively opened and closed to allow access to the cavity of the container through a second opening, and to close the second opening. The two openings may be oriented to face in two different directions relative to the cavity. The doors may be hinged to the container at opposite edges of the doors and the openings may be in mutual communication.

The apparatus may include a latch for holding the doors closed. The doors may also include friction tabs that engage with the inside walls of the container to independently hold the doors shut.

At least one slide may be selectively disposed within the parallel opposed compartments to cooperate with the members to retain the bags. The slide is particularly useful for retaining and compressing bags that are narrower in width than the distance between the opposed members. Thus, bags of different sizes can be stored, even intermixed.

Each of the longitudinal members may feature a notch positioned along the length of the member opposite to a like notch, for example, in the oppositely positioned member along the other surface. With a plurality of such pairs of members, the notches in the members disposed along each of the surfaces may be longitudinally displaced relative to the notches in the adjacent members so that notches in the members along each of the surfaces form an oblique array relative to the members. The array is preferably angled toward the openings of the container to facilitate insertion of the bags.

The container may comprise a box having an open end and pivotally connected to a base such that the box is rotationally movable about the pivotal connection relative to the base between a first configuration, in which the open end of the box is exposed away from the base to provide access to the cavity, and a second configuration in which the open end of the box is within the base and closed, at least in part, by the end portion of the base. The box at its open end may be recessed to facilitate rotation of the box into and out of the second configuration.

The container may include a support by which the container may be generally suspended. The support may be in the form of a frame to which a box including the cavity may be hinged for rotation between an operative configuration, with the access generally directed upwardly, and configurations slanted relative to the frame.

The present invention thus provides apparatus for storing and dispensing bags wherein the bags may be selectively removed one at a time or in groups. The apparatus has an opening into its interior where the bags are stored. Bags of different sizes may be retained by the apparatus such that they may be selectively removed one or more at a time.

BRIEF DESCRIPTION OF THE DRAWINGS

FIG. 8 is a perspective view of another version of a container according to the present invention;

FIG. 9 is a top plan view of the container of FIG. 8;

FIG. 10 is a side elevational view of another version of a slide according to the present invention; and FIG. 11 is a fragmentary lateral cross section taken along line 11—11 of FIG. 10.

DESCRIPTION OF THE PREFERRED EMBODIMENTS

Figures 1, 2:
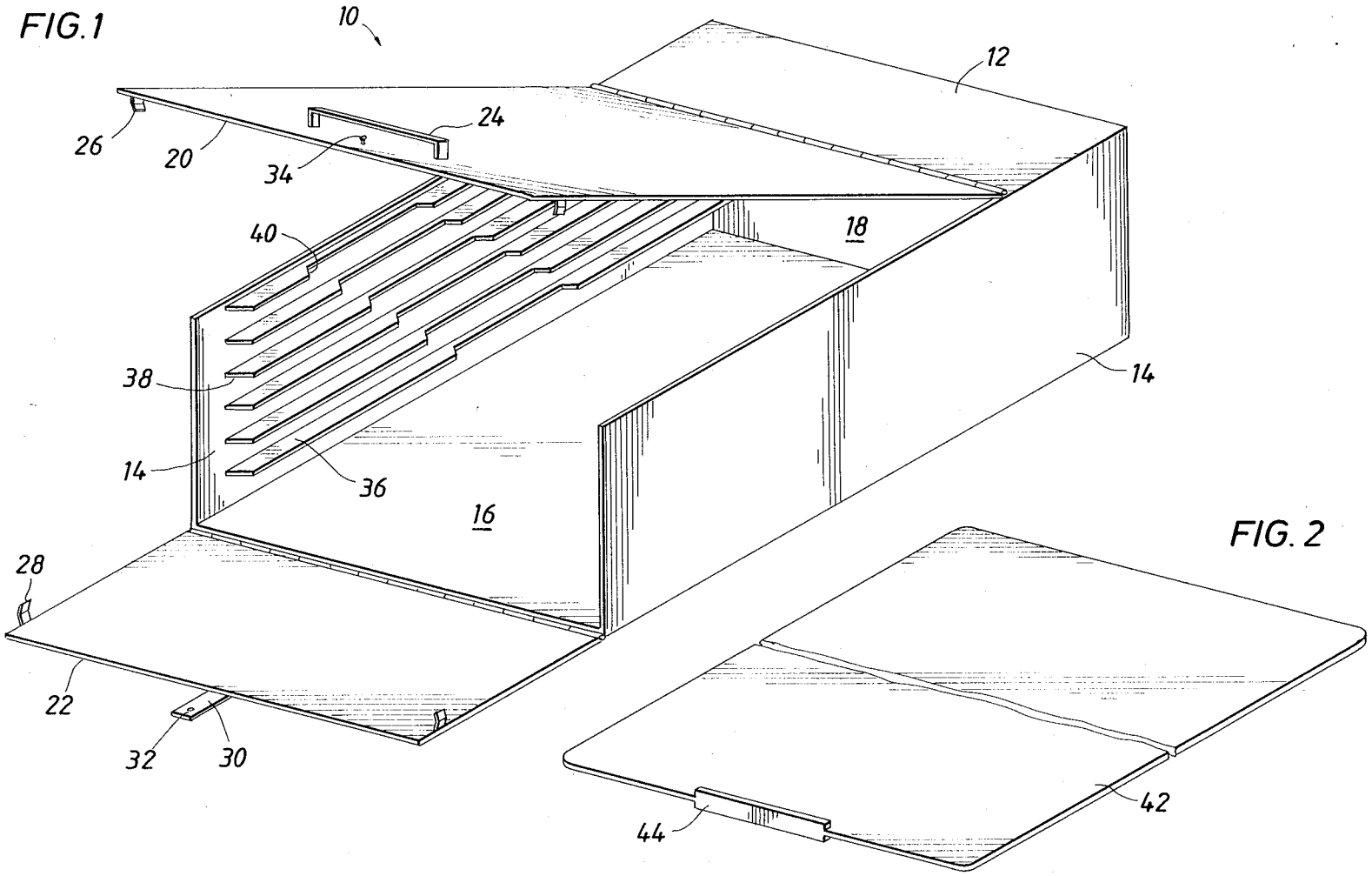
FIG. 1 is a perspective view of a container for storing and dispensing bags according to the present invention, shown with doors open.
FIG. 2 is a perspective view of a slide according to the present invention.
Figure 3:
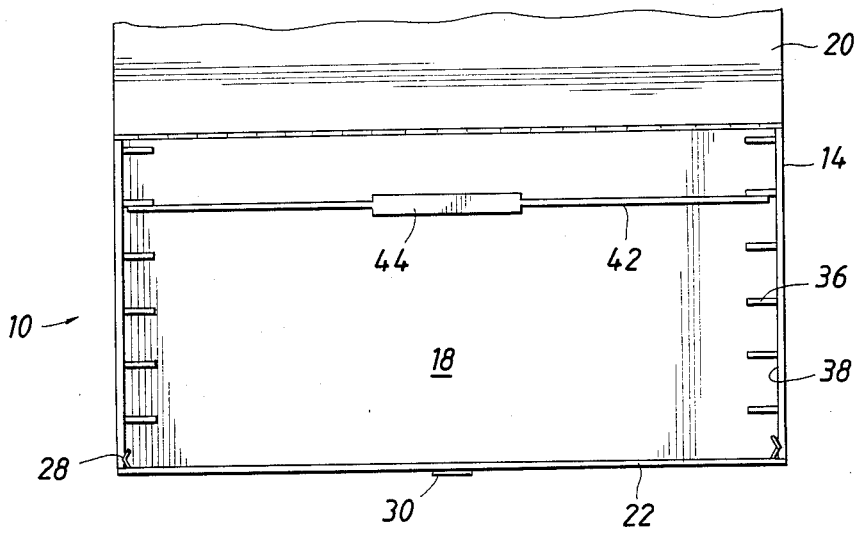
FIG. 3 is a front elevational view of the container of FIG. 1 with the slide of FIG. 2 shown disposed in a pair of the opposed compartments.

A container for storing and dispensing bags according to the present invention is shown generally at 10 in FIGS. 1 and 3. The container 10 provides an interior cavity and includes a top 12, two opposed longitudinally-extending sides 14, a bottom 16, and a rear end piece 18, the cavity being defined, at least in part, by the interior surfaces of the elements 12–18.

The top piece 12 is preferably shorter than the bottom 16 to allow a top opening into the container 10. A door 20, hinged to the top piece 12, closes over the top opening. The front end of the container 10 is closed by a second door 22, hinged at the front edge of the container bottom piece 16. The doors 20 and 22 may be opened separately for access through the top or front, respectively, of the container 10. Opening both doors 20 and 22 together provides an enlarged opening for access to the interior of the container.

The top door 20 is fitted with a handle 24 for opening and closing the door. A pair of friction tabs 26 is mounted on the interior side of the top door 20 such that when the door is closed the tabs engage the interior surfaces of the sidewalls 14 to latch the door closed. Each tab 26 comprises an angled portion to facilitate entry of the tab along the inside of the respective wall 14, and yields sufficiently to provide a friction engagement with the wall to hold the top door 20 closed, but release the door for opening. A similar pair of friction tabs 28 is mounted on the front door 22 to engage the interior surfaces of the sides 14 to hold that door closed.

The two doors 20 and 22 are hinged to the container 10 at opposite edges of the doors such that the top and front openings are in mutual communication to provide a continuous opening when the doors are opened. The edges of the doors 20 and 22 opposite the hinges meet when the doors are closed to completely close the container 10.

A flexible strap or the like 30 attached to the exterior of the front door 22 includes a hole 32 whereby the strap may receive and engage a latch pin 34 extending from the exterior of the top door 20 for latching the two doors closed. With both doors 20 and 22 closed, the strap 30 is flexed to loop the pin 34. The pin 34 includes a spheroid head to facilitate interaction with the strap 30. The latching of the strap 30 and the pin 34, for example, allows the container 10 to be moved about, restraining the doors 20 and 22 from becoming accidentally opened during movement.

Elongate flange members 36 extend longitudinally along the interior surfaces of both sidewalls 14, arranged in opposed pairs to defined, at least in part, opposed compartments 38. The lowermost members 36 define such opposed compartments 38 in cooperation with the container bottom 16 as well as the sidewalls 14. The edges of bags positioned within the container 10 may be received within oppositely facing compartments 38 whereby the bags may be retained within the container 10, constrained by the flanges 36.

Each of the members 36 features a longitudinally-extending notch 40, with the notches in opposing members being positioned at like locations along their longitudinal extent. The notches 40 facilitate insertion of bags under the notched members 36, and removal therefrom, through the top opening of the container 10. Accordingly, the notches 40 in the collection of flange members 36 are arranged in oblique array, being positioned progressively toward the back of the container the lower the member is located along the sidewall 14. Thus, bags may be inserted through the top opening with one end of the bags being moved through the array of notches to the members 36 selected to constrain the bags in question, with the bags then inserted toward the back of the container in the corresponding compartments below such members. The partially inserted bags may then be bent and their opposite ends moved through the array of notches 40 to be positioned under the forward portions of the constraining members 36, and the bags flattened through the notches. Similarly, the bags may be withdrawn through the top opening of the container 10 by being bent and raised through the notches 40. Alternatively, the bags may be simply bent somewhat longitudinally and raised out from under the constraining members 36 through the top opening of the container 10.

Access to the cavity of the container 10 through the front opening allows bags to be inserted directly in the selected compartments 38 through the front of the container, and withdrawn therefrom as desired.

FIG. 2 shows a slide 42 that may be disposed within opposed compartments 38 as illustrated in FIG. 3. The slide 42 is in the form of a rectangular, flat plate that, when inserted, extends into the opposed compartments 38. A grip 44 extends from the upper and lower surfaces of the front edge of the slide 42 for manipulating the slide into or out of the opposed compartments 38. Such a grip may take other forms, such as a thumb hole (as discussed hereinafter) that may be engaged for such slide manipulation.

The slide 42 may be disposed above bags that are located in opposed compartments 38 beneath the slide 42, as indicated by the illustration of FIG. 3 which shows the slide elevated within opposed compartments. In this manner, the slide 42 may compress bags against opposed members 36, or the container bottom 16, located below the slide. Bags having widths narrower than the distance between opposed members 36 may also be retained below the slide 42. The constraint, and even compression, of these narrower bags by the slide 42 retains the bags in position and inhibits their moving about within the container 10. Such narrower bags may be held down against the container bottom 16, other bags, or another slide 42. Use of multiple slides 42 allows different sized bags, for example, to be compressed between each pair of slides, and allows such bags or groups of bags to be removed without disturbing the remaining contents of the container 10.

Figure 4:
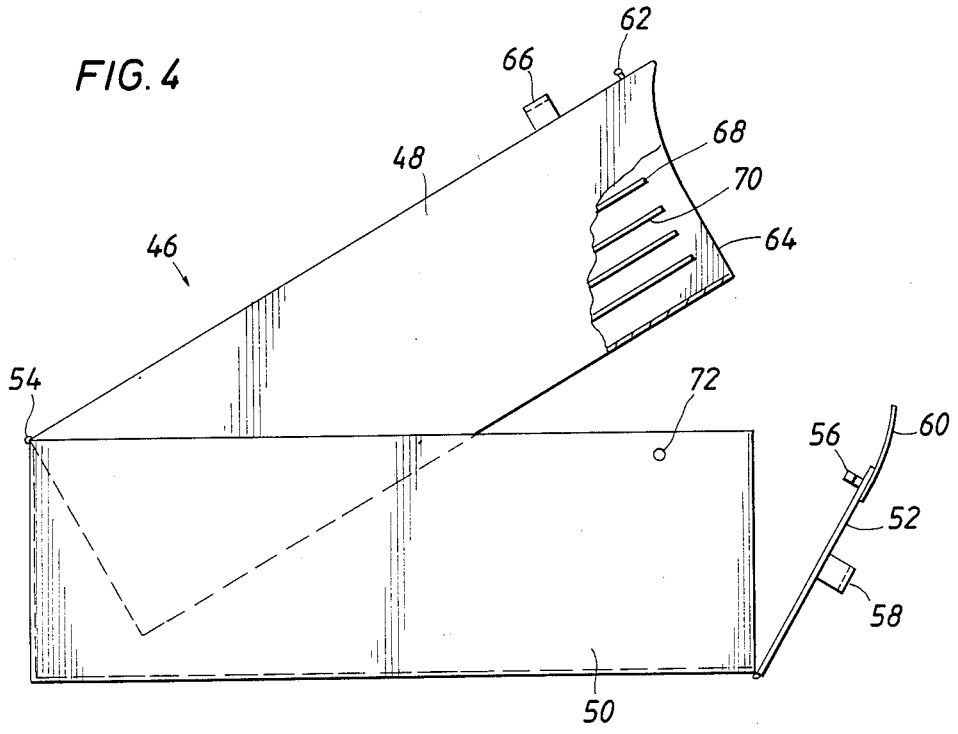
FIG. 4 is a side elevational view, partially cut away, of another version of a container according to the present invention, including a box pivotally connected to a base.

Another version of a container according to the present invention is shown generally at 46 in FIG. 4. The container 46 includes an open-ended box 48 pivotally connected to a base 50. The base 50 is complete on three sides and the bottom, and features a hinged door 52 at one end opposite the location of the hinge 54 providing the pivotal connection to the box 48.

The base door 52 is fitted with friction tabs 56 for frictionally latching the door to the elongate sides of the base 50, and a handle 58 for manipulating the door. A flexible strap 60, featuring an appropriate hole (not shown) may engage a spheroid latch pin 62 carried by the top of the box 48 for mutually locking the door 52 the base and the box.

As may be appreciated by reference to FIG. 4, the hinge 54 is so positioned that the box 48 may be stored within the base 50, whereby the base door 52 may be opened to provide access to the interior of the box through the box open end. Further, the box 48 may be pivotally raised relative to the base 50 so that, even with the base door 52 closed, the interior of the box is exposed for insertion or removal of bags relative thereto. The edges 64 defining the perimeter of the box end opening, at least in part, may be recessed as shown to facilitate rotational movement of the box 48 into and out of the base 50. A handle 66 is mounted on the top of the box whereby the box may be so manipulated relative to the base 50.

The interior of the box 48 is fitted with opposed flange members 68 along the elongate sides of the box, in part defining longitudinally-extending compartments 70. A slide such as the slide 42 shown in FIG. 2 may be utilized in the box 48 in the manner described hereinbefore in conjunction with the container 10.

The opposed, elongate sides of the base 50 carry springloaded lugs 72 extending through appropriate openings in the base sides. A coil spring (not visible) urges each lug 72 outwardly relative to the base 50 in an extended configuration, allowing positioning of the box 48 within the base. With the box 48 raised relative to the base 50, each lug 72 may be manually moved to a retracted configuration, further compressing the spring, wherein the lug extends within the confines of the base 50 and provides a resting point on which the box may be placed, thus maintaining the box oriented at a tilt relative to the base to allow ready access through the box end opening to the cavity of the box. Frictional contact between the bottom of the box 48 and the lugs 72, for example, maintains the lugs retracted to support the box. Alternatively, the lugs 72 may be grooved to receive an edge of the box that might be formed by constructing detents (not shown) along the bottom edge of the box to retain the lugs in their retracted configurations. In any event, lifting of the box 48 off of the lugs 72 permits the lug springs to extend the lugs 72 to allow lowering of the box to its closed configuration within the base 50.

Figure 5:
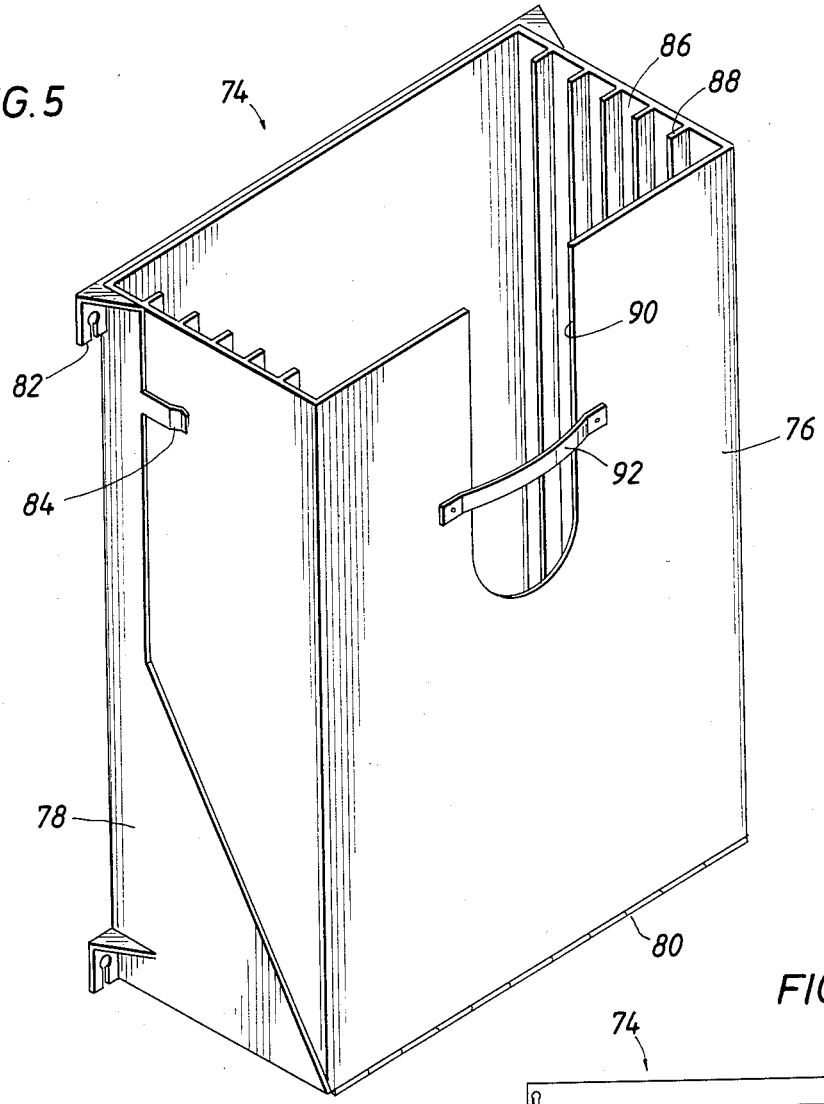
FIG. 5 is a perspective view of another version of a container according to the present invention, including a support frame.
Figure 6:
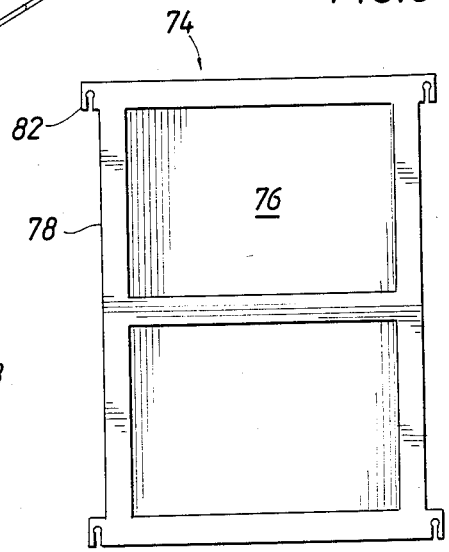
FIG. 6 is a back elevational view of the container of FIG. 5.
Figure 7:
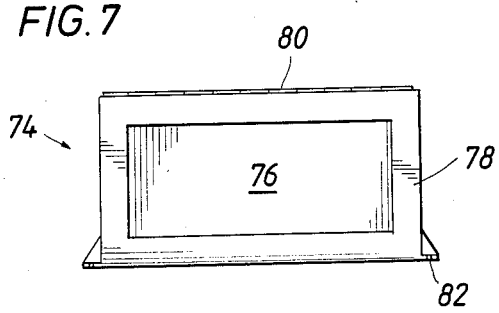
FIG. 7 is a bottom plan view of the container of FIGS. 5 and 6.

Still another version of a container according to the present invention is shown generally at 74 in FIGS. 5–7. The container 74 includes an open-ended box 76 connected to a support frame 78 by a hinge 80 joining the bottom forward edge of the box to the adjacent edge of the frame. A lug 82 positioned at each back corner of the frame 78 includes a downwardly-facing recess for receiving a support device, such as a projecting screw, or hook, or the like, whereby the frame may be suspended, in a generally vertical orientation as illustrated in FIGS. 5 and 6, from a wall or the like. Then, the box 76 is rotatable on the hinge 80 relative to the frame 78 between an operative orientation, as illustrated in FIGS. 5 and 6, with the open end of the box directed generally upwardly, for example, for storing bags therein and removal of bags therefrom, and configurations wherein the box is slanted relative to the frame 78. With the box 76 thus tilted, bags may perhaps more easily be inserted therein. The frame 78 includes a pair of friction tabs 84 (only one visible in FIG. 5) extending on either side thereof to frictionally engage the outer side surfaces of the box 76 when the latter is oriented generally vertically, that is, in an operative configuration.

Within the cavity of the box 76, compartments 86 are defined, at least in part, by paired, opposed elongate flange members 88 arranged on the interior side surfaces of the box. As discussed hereinbefore in the matter of the container versions 10 and 46, bags of different sizes may be constrained within the compartments 86 by the elongate members 88. Additionally, a slide, such as the previously described slide 42 for example, may be utilized in conjunction with the elongate members 88 to constrain the bags.

The front surface of the box 76 is broken by a recess 90 through which bags contained within the box may be grasped, for example, whereupon the bags may then be lifted through the open top of the box. A handle 92 is attached to the front of the box 76 for use in manipulating the box relative to the frame, for example.

Another version of a container according to the present invention is shown generally at 94 in FIGS. 8 and 9, and includes a box 96 with an open top end and a front face shortened to extend the opening 98. Holes 100 in the back of the box 96 may receive hooks, screws or the like by which the box may be supported in a generally vertical, operative configuration, for example. A slot 102 provides a hand hold for manipulation of the box 96.

Elongate compartments 106 are defined, in part, by elongate flange members 104 arranged in pairs of opposed members positioned along the interior side surfaces of the box 96. Bags may be constrained, and even compressed, within the compartments 106 as discussed in relation to the embodiments described hereinbefore. A slide, such as the slide 42 illustrated in FIG. 2, may be inserted within a compartment 106 to cooperate with the members 104 to constrain bags of various sizes, for example.

The container 94 has no doors or exposed handles or latches, and may be utilized for storing and dispensing bags with the box 96 standing upright as illustrated, supported on a wall or the like by the holes 100, or lying on its side or back, for example.

FIG. 10 illustrates another version of a slide 108, with further detail shown in FIG. 11. A finger hole 110 is provided toward one end of the slide 108 for gripping thereof. The opposite end, or bottom, of the slide 108 is broken by an indent 112.

Each side edge of the slide 108 is provided in the form of a rim 114, defined by an elongate shoulder 116, for engaging and sliding along the elongate members 104 of the container 94, for example. However, it will be appreciated that either of the slides 42 or 108 may be utilized with any of the embodiments of the container illustrated and described herein, for example.

The present invention provides a container for storing and dispensing bags, such as folded paper bags or the like that may be stacked and somewhat compressed together, for example. The bags may be inserted into and withdrawn from the container through the top of the container, or through the front of the container, or both, depending on the embodiment. Members line the sides of the container to constrain the bags, directly and/or by means of a slide which may be positioned within compartments defined, at least in part, by the members. In one version of the container, a hinged top door of the container may be opened to provide access through the top of the container to the interior thereof. In another version of the container, the bags are stored in a box hinged to a base whereby the box may be lifted to expose an open end of the box for insertion and removal of bags. Yet another version of the container includes a box hinged to a frame which may be supported from a wall or the like, with the end of the box providing access for insertion of bags into the box and removal of bags therefrom. In the case of still another version of the container, bags may be inserted into the container through an open end of the box of the container, and withdrawn therefrom, with the box opening extending partly along the front of the box.

It will be appreciated that access to the interior of the container through the top thereof may be useful in circumstances wherein the container is stored in a drawer or other environment prohibiting access to the interior of the box through the front thereof. Likewise, access to the interior of the container directly through the front thereof is useful, for example, where the container is positioned on a shelf or the like. Two embodiments of the present invention are particularly useful in supporting the container in a generally vertical orientation, for example, with one of the embodiments able to be used in a variety of orientations. In any event, bags may be inserted and/or removed one at a time or in groups as desired. A relatively large quantity of bags may be stored in a container according to the present invention by compressing the bags under the flange members, or by means of one or more slides, for example. Further, bags of different sizes may be stored and dispensed by means of a container according to the present invention.

The foregoing disclosure and description of the invention is illustrative and explanatory thereof, and various changes in the sizes, shapes and materials as well as in the details of the illustrated constructions may be made within the scope of the appended claims without departing from the spirit of the invention.

What is claimed is:

1. Apparatus for storing and dispensing bags, comprising:

a. a container having a cavity and including two substantially opposed interior surfaces defining said cavity in part;

b. access means to said cavity; and c. a plurality of pairs of mutually opposed longitudinal members disposed along said two interior surfaces and defining, at least in part, parallel opposed compartments along said surfaces, with each of said members along said surfaces featuring a notch positioned along said member opposite to a like notch in the oppositely positioned member along said other surface;

d. whereby bags may be positioned within said cavity and retained by means of said members, and may be selectively removed from said container.

2. Apparatus as defined in claim 1 further comprising means for selectively opening and closing said access means.

3. Apparatus as defined in claim 2, wherein said means for opening and closing said access means comprise a door hinged to said container and movable between a first configuration, in which said door allows access through said container to said cavity through a first opening, and a second configuration, in which said door closes said opening.

4. Apparatus as defined in claim 3:

a. wherein said means for opening and closing said container further comprise a second door hinged to said container and movable between a first configuration, in which said second door allows access through said container to said cavity through a second opening, and a second configuration, in which said second door closes said second opening; and b. wherein said first and second openings are oriented to face in different directions relative to said cavity.

5. Apparatus as defined in claim 4 wherein said first and second openings are in mutual communication.

6. Apparatus as defined in claim 5, wherein:

a. said first door and said second door meet together in said respective second configurations; and b. said doors are hinged to said container at opposite edges of said doors.

7. Apparatus as defined in claim 4 further comprising latch means for latching said first and second doors in their respective second configurations.

8. Apparatus as defined in claim 3 further comprising latch means for latching said door in said second configuration.

9. Apparatus as defined in claim 1 wherein notches in members disposed along each said surface are longitudinally displaced relative to notches in adjacent members so that said notches in members along each said surface form an oblique array relative to said members.

10. Apparatus as defined in claim 1 further comprising a slide which may be disposed within said container, extending into one said pair of opposed compartments to cooperate with said members for so retaining bags.

11. Apparatus as defined in claim 10 wherein said slide comprises means whereby said slide may be engaged for manipulation of said slide.

12. Apparatus as defined in claim 10 wherein said slide comprises rim means along at least one edge of said slide for engaging at least one of said longitudinal members.

13. Apparatus for storing and dispensing bags, comprising:

a. a container having a cavity and including two substantially opposed interior surfaces defining said cavity in part;

b. access means to said cavity;

c. a plurality of pairs of mutually opposed longitudinal members disposed along said two interior surfaces and defining, at least in part, parallel opposed compartments along said surfaces whereby bags may be positioned within said cavity and retained by means of said members, and may be selectively removed from said container; and d. a slide which may be disposed within said container, extending into one said pair of opposed compartments to cooperate with said members for so retaining bags by holding such bags against at least one of the container, another slide or a pair of said opposed members.

14. Apparatus as defined in claim 13 wherein:

a. each of said members along said surfaces features a notch positioned along said member opposite to a like notch in the oppositely positioned member along said other surface; and b. notches in members disposed along each said surface are longitudinally displaced relative to notches in adjacent members so that said notches in members along each said surface form an oblique array relative to said members.

15. Apparatus as defined in claim 13:

a. wherein said container comprises a box with an open end for access to said cavity therein:

b. means for opening and closing said container comprising a base including an end portion; and c. wherein said base is pivotally connected to said box so that said box is rotationally movable about said pivotal connection relative to said base between a first position, in which said open end of said box is exposed away from said base to provide access to said cavity, and a second position, in which said open end of said box is within said base and closed, at least in part, by said end portion of said base.

16. Apparatus as defined in claim 15 wherein edges of said box defining, at least in part, said box open end are recessed, at least in part.

17. Apparatus as defined in claim 15 wherein said end portion of said base comprises a door, movable between a first configuration, in which said door allows access through said open end of said box to said cavity with said box in said second position, and a second configuration in which said door closes said box open end with said box in said second position.

18. Apparatus as defined in claim 13 further comprising support means whereby said container may be generally suspended in an operative configuration.

19. Apparatus as defined in claim 18 wherein said support means comprises a frame which may be suspended, and to which said container is pivotally connected whereby the orientation of said container may be selectively adjusted between a generally upright, operative configuration with said access generally directed upwardly, and configurations slanted relative to said frame.

20. Apparatus as defined in claim 13 further comprising means for selectively opening and closing said access means.

21. Apparatus as defined in claim 20, wherein said means for opening and closing said access means comprise a door hinged to said container and movable between a first configuration, in which said door allows access through said container to said cavity through a first opening, and a second configuration, in which said door closes said opening.

22. Apparatus as defined in claim 21:

a. wherein said means for opening and closing said container further comprise a second door hinged to said container and movable between a first configuration, in which said second door allows access through said container to said cavity through a second opening, and a second configuration, in which said second door closes said second opening; and b. wherein said first and second openings are oriented to face in different directions relative to said cavity.

23. Apparatus as defined in claim 22 wherein said first and second openings are in mutual communication.

24. Apparatus as defined in claim 23, wherein:

a. said first door and said second door meet together in said respective second configurations; and b. said doors are hinged to said container at opposite edges of said doors.

25. Apparatus as defined in claim 22 further comprising latch means for latching said first and second doors in their respective second configurations.

26. Apparatus as defined in claim 21 further comprising latch means for latching said door in said second configuration.

27. Apparatus as defined in claim 13 wherein said slide comprises means whereby said slide may be engaged for manipulation of said slide.

28. Apparatus as defined in claim 13 wherein said slide comprises rim means along at least one edge of said slide for engaging at least one of said longitudinal members.

* * * * *